US007917987B2

(12) United States Patent
Kim

(10) Patent No.: US 7,917,987 B2
(45) Date of Patent: Apr. 5, 2011

(54) AIR-INJECTION TYPE TOOL FOR SCRUBBING OFF THE DIRT ON A BODY

(75) Inventor: Hyun Jong Kim, Anyang (KR)

(73) Assignee: U-MI Tech, Jeonjoo (KR)

( * ) Notice: Subject to any disclaimer, the term of this patent is extended or adjusted under 35 U.S.C. 154(b) by 857 days.

(21) Appl. No.: 11/909,844

(22) PCT Filed: Jul. 27, 2005

(86) PCT No.: PCT/KR2005/002440

§ 371 (c)(1),
(2), (4) Date: Sep. 27, 2007

(87) PCT Pub. No.: WO2006/104300

PCT Pub. Date: Oct. 5, 2006

(65) Prior Publication Data

US 2008/0189893 A1 Aug. 14, 2008

(30) Foreign Application Priority Data

Mar. 29, 2005 (KR) ..... 10-2005-0026006
Jun. 3, 2005 (KR) ..... 20-2005-0015956

(51) Int. Cl.
*A47K 7/04* (2006.01)

(52) U.S. Cl. ..... 15/229.11; 15/233; 15/229.13

(58) Field of Classification Search ..... 15/229.11, 15/229.13, 229.14, 230.18, 233
See application file for complete search history.

(56) References Cited

U.S. PATENT DOCUMENTS 7,269,875 B1 * 9/2007 Grimes ..... 15/119.2

FOREIGN PATENT DOCUMENTS

| | | | |
|---|---|---|---|
| JP | 8-24158 | A | 1/1996 |
| KR | 1983-3634 | A | 12/1983 |
| KR | 1995-399 | A | 1/1995 |
| KR | 1996-9760 | A | 11/1996 |

* cited by examiner

*Primary Examiner* — Shay L Karls
(74) *Attorney, Agent, or Firm* — Jefferson IP Law, LLP

(57) ABSTRACT

The present invention discloses an air-injection type tool for scrubbing off the dirt on a body including: an air-retaining body 2 formed of an elastic material expandable in an air-injection manner, the air-retaining body 2 having a scrubbing towel 40 encompassed on the external surface thereof; a disc-like support body 4 disposed at the inside of the air-retaining body 2 and having a cylindrical coupling protrusion 6 formed at the top central portion thereof, the cylindrical coupling protrusion 6 having a piston A reciprocated therein such that the air generated by the reciprocating motion of the piston A is sent to the air-retaining body 2; and a cover body 12 adapted to be pressurized by a handle 18 screw-coupled with the coupling protrusion 6 of the support body 4 thus to come into close contact with the support body 4 such that the air-retaining body 2 is kept airtight.

5 Claims, 3 Drawing Sheets

[Fig. 1]
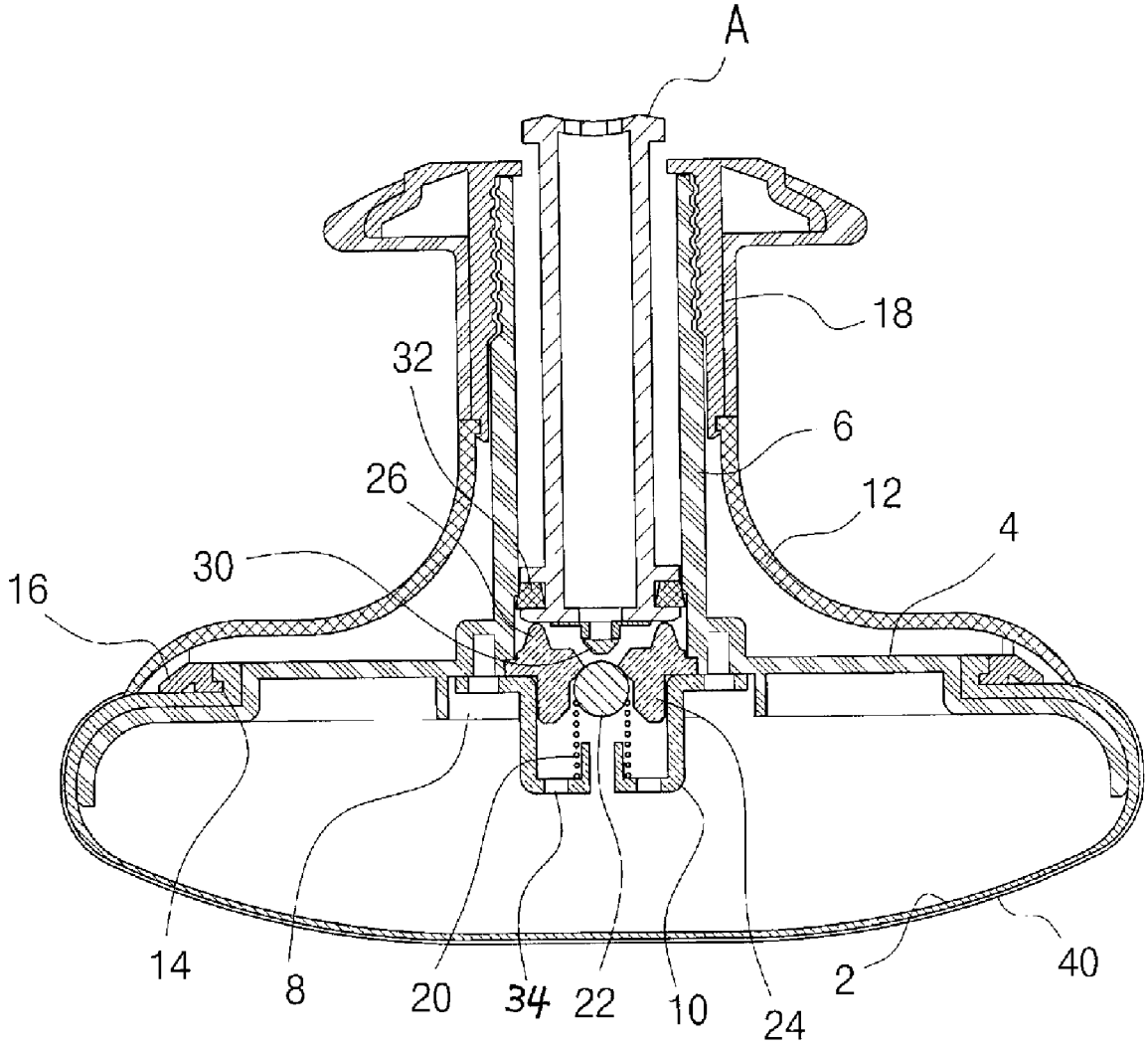

[Fig. 2]
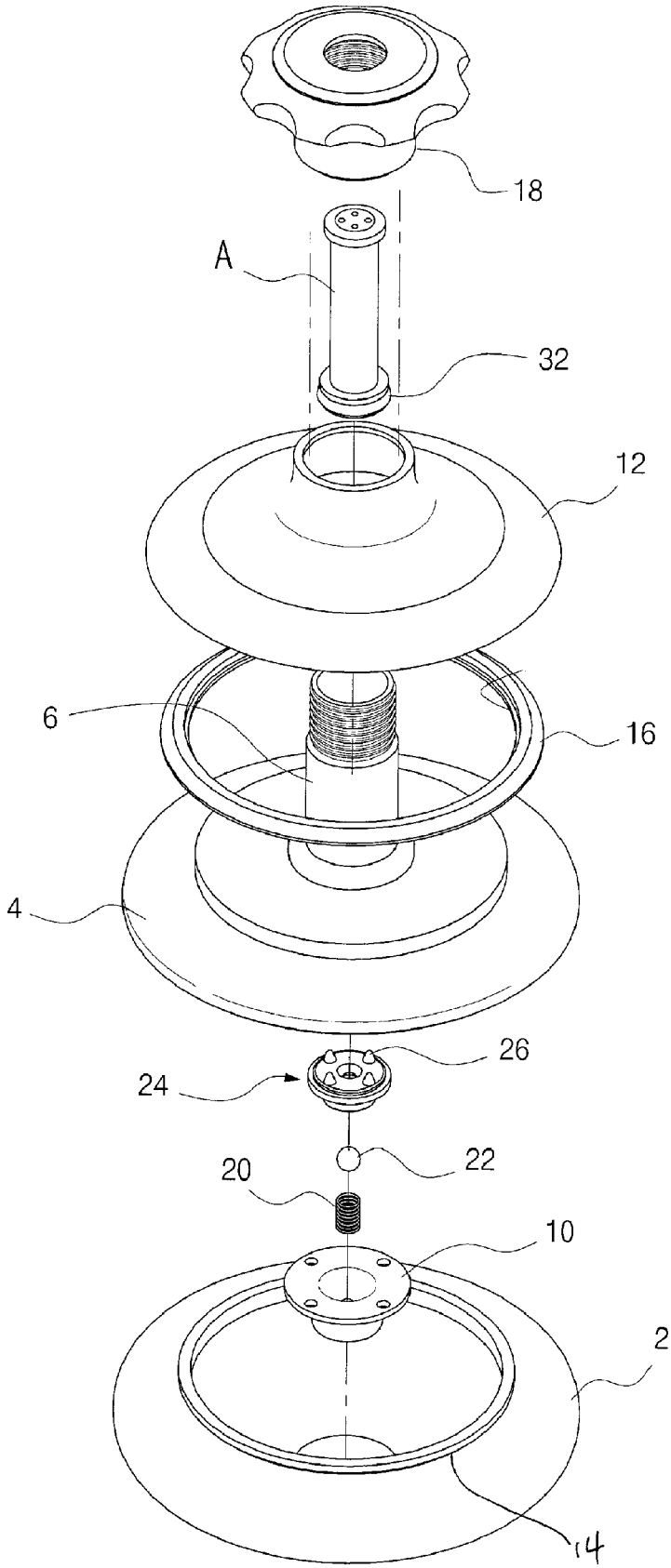

[Fig. 3]
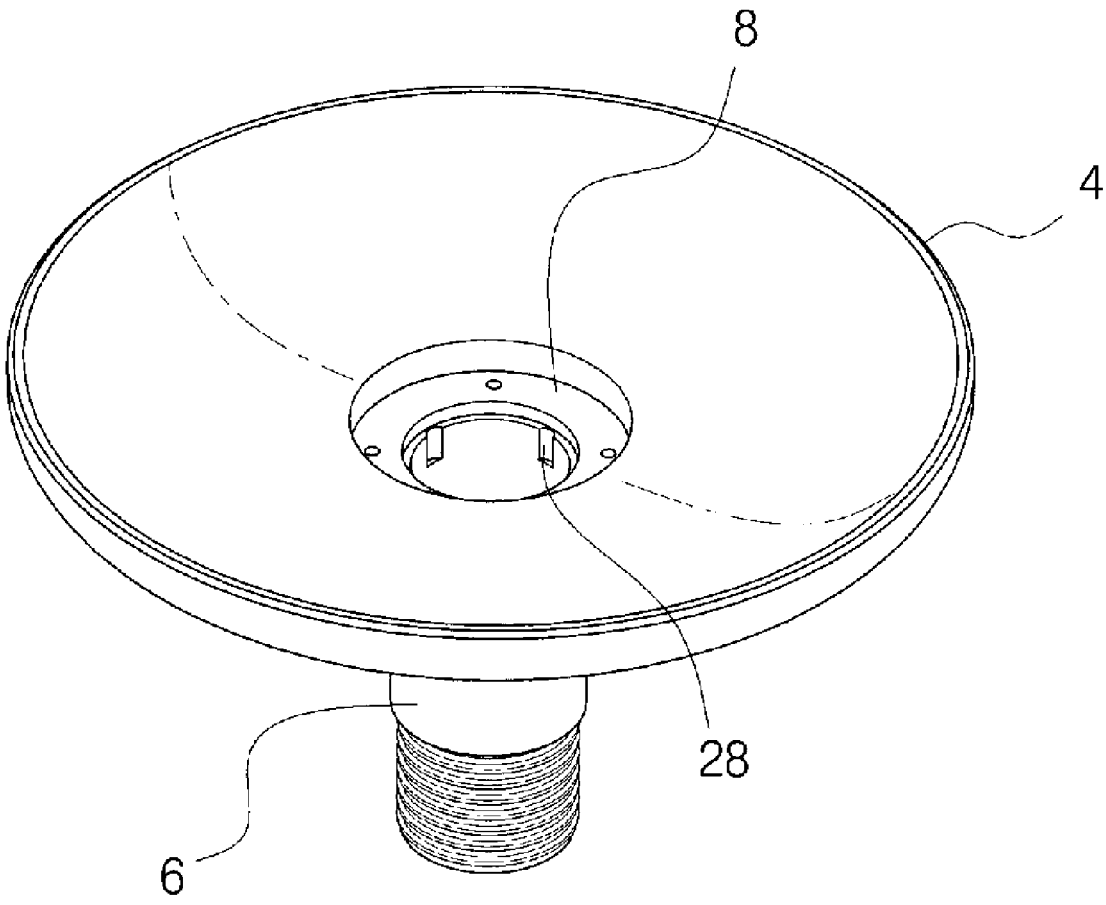

AIR-INJECTION TYPE TOOL FOR SCRUBBING OFF THE DIRT ON A BODY

TECHNICAL FIELD

The present invention relates to an air-injection type tool for scrubbing off the dirt on a body, and more particularly, an air-injection type tool for scrubbing off the dirt on a body which is provided with an air-retaining body encompassed with a scrubbing towel and expanded like a ball when air is supplied such that the dirt on a user's body is scrubbed off gently, without having any damage or pain on user's skin, as the air into the air-retaining body is moved.

BACKGROUND ART

Conventionally, towels or square pockets that are made of a rough fabric are used to scrub off the dirt on a body.

It is well known, however, that they are inconvenient to use, and especially, the square pockets are often separated from a user's hand while a user is scrubbing off the dirt on his or her body, which makes a user feel unpleasant.

Furthermore, if a force applied when a user scrubs off the dirt gets stronger, a user feels a pain due to the friction of the rough towels against his or her skin. Even though the strong force is applied, in some cases, there occurs a problem that the dirt is not scrubbed off well from the body.

So, a towel having a sponge pad formed integrally with the inside thereof has been proposed to reduce the pain felt during the scrubbing off the dirt, but when the sponge of the towel is soaked, the elasticity thereof gets low such that a user feels a pain when he or she scrubs off the dirt on his or her body and the dirt is not scrubbed off well.

DISCLOSURE OF INVENTION

Accordingly, the present inventor has been made to solve the above-described problems, and it is an object of the present invention to provide an air-injection type tool for scrubbing off the dirt on a body which is provided with an air-retaining body encompassed with a scrubbing towel and expanded like a ball when air is supplied such that the dirt on a user's body is scrubbed off gently, without having any damage or pain on the user's skin, as the air in the air-retaining body is moved.

To accomplish the above object, according to the present invention, there is provided an air-injection type tool for scrubbing off the dirt on a body including: an air-retaining body formed of an elastic material expandable in an air-injection manner, the air-retaining body having a scrubbing towel encompassed on the external surface thereof; a disc-like support body disposed at the inside of the air-retaining body and having a cylindrical coupling protrusion formed at the top central portion thereof, the cylindrical coupling protrusion having a piston reciprocated therein such that the air generated by the reciprocating motion of the piston is sent to the air-retaining body; and a cover body adapted to be pressurized by a handle screw-coupled with the coupling protrusion of the support body thus to come into close contact with the support body such that the air-retaining body is kept airtight.

BRIEF DESCRIPTION OF THE DRAWINGS

Further objects and advantages of the invention can be more fully understood from the following detailed description taken in conjunction with the accompanying drawings, in which:

FIG. 1 is a sectional view showing the assembled parts of an air-injection type tool for scrubbing off dirt on a body according to the present invention;

FIG. 2 is an exploded perspective view showing the principal parts of the air-injection type of ball of the present invention; and FIG. 3 is a perspective view showing the bottom face of a support body of the air-injection type of ball of the present invention.

BEST MODE FOR CARRYING OUT THE INVENTION

Now, an explanation on the preferred embodiments of the present invention will be in detail given with reference to attached drawings, wherein the corresponding parts of FIGS. 1 to 3 are indicated by like reference numerals.

FIG. 1 is a sectional view showing the assembled parts of an air-injection type tool for scrubbing off dirt on a body according to the present invention, FIG. 2 is an exploded perspective view showing the principal parts of the air-injection type of ball of the present invention, and FIG. 3 is a perspective view showing the bottom face of a support body of the air-injection type of ball of the present invention.

According to the present invention, as shown in FIGS. 1 and 2, there is provided an air-injection type tool for scrubbing off the dirt on a body including: an air-retaining body 2 formed of an elastic material expandable in an air-injection manner, the air-retaining body 2 having a scrubbing towel 40 encompassed on the external surface thereof; a disc-like support body 4 disposed at the inside of the air-retaining body 2 and having a cylindrical coupling protrusion 6 formed at the top central portion thereof, the coupling protrusion 6 having a piston A reciprocated therein such that the air generated by the reciprocating motion of the piston A is sent to the air-retaining body 2; and a cover body 12 adapted to be pressurized by a handle 18 screw-coupled with the coupling protrusion 6 of the support body 4 thus to come into close contact with the support body 4 such that the air-retaining body 2 is kept airtight.

The air-retaining body 2 is of a dome-like shape, and has a reentrant portion 14 formed along the top end outer periphery thereof, such that a fixing rim 16 is fit along the reentrant portion 14 thus to make the inside of the cover body 12 come into close contact with the fixing rim 16, which allows the air-retaining body 2 to be kept airtight.

The coupling protrusion 6 that is placed at the central portion of the support body 4 is of a cylindrical shape that is hollow in the interior thereof to conduct the reciprocating motion of the piston A therein, the coupling protrusion 6 having a stepped depression portion 8 at the lower end of the central portion thereof, the depression portion 8 having a cap 10 fit there into by means of screws, the cap 10 having a spring 20, a ball 22 and a packing 24 mounted at the inside thereof in such a fashion that the ball 22 comes into close contact with the packing 24 by the elasticity of the spring 20, with a result that the air-retaining body 2 is kept airtight.

The cap 10 has a plurality of air passages 34 pierced at the bottom surface thereof, for flowing in and out air therethrough.

The packing 24 is pierced up and down at the central portion thereof such that the ball 22 elastically supported by the spring 20 advances to the inside thereof, the packing 24 having a plurality of protrusions 26 formed at the top surface thereof, the protrusions 26 maintaining a given distance from the end portion of the piston A and distorted in shape by the piston A when the piston A is depressed.

The coupling protrusion 6 has a plurality of air discharging slots 28 radially formed along the inner periphery thereof thus to be contacted with the depression portion 8 that is formed at the lower end portion thereof, such that when the piston A is depressed, the protrusions 26 on the packing 24 are depressed thus to push the ball 22 by means of a protrusion 30 formed at the bottom end of the piston A and thus the air discharging slots 28 are opened to the outside thus to discharge the air into the air-retaining body 2.

In the case where a piston packing 32 that is mounted around the outer periphery of the front end of the piston A is placed at an operating position thereof, the air discharging slots 28 are formed lower than the piston packing 32 such that the air discharging slots 28 are closed normally and only if the piston A is depressed, they are opened to the outside.

Under the above configuration, the conventional scrubbing towel 40 is encompassed on the outer surface of the air-retaining body 2, and the air-retaining body 2 is disposed at the external side of the support body 4 by means of the fixing rim 16. Then, the cover body 12 is mounted on the support body 4 and the handle 18 is coupled to the support body 4. As the handle 18 is moved down, the inside of the cover body 12 is pressed against the fixing rim 16 such that the air-retaining body 2 is kept airtight and at the same time, the scrubbing towel 40 is firmly fixed to the air-retaining body 2.

In this state, if the piston A that is exposed to the top portion of the handle 18 is operated up and down, the external air pushes the ball 22 such that the air is charged to the air-retaining body 2 under the principles of the piston, thereby making the air-retaining body 2 expanded.

When the air is injected in given amounts, the piston A is placed down and the scrubbing is started.

Instead of pushing the piston, at this time, air from a user's mouth is supplied from the top portion of the piston to the inside of the piston such that the ball 22 is pushed to supply the air into the air-retaining body 2.

When the scrubbing is carried out after the air is filled in given amounts in the air-retaining body 2, the air in the air-retaining body 2 is moved in the opposite direction to the direction where a scrubbing force is applied. As a result, the scrubbing is gently conducted, without giving any damage to user's skin.

If the air is to be discharged after the scrubbing is finished, the piston A is depressed to push the protrusions 26 on the top end of the packing 24 such that the protrusions 26 are depressed thus to move the piston A down. Also, the protrusion 30 formed at the bottom end of the piston A pushes the ball 22 to allow the air charged in the air-retaining body 2 to be discharged through the air passages 34 pierced on the cap 10, thus making the discharged air leaked between the piston packing 32 and the air discharging slots 28.

In the case where the scrubbing towel 40 is damaged or if the scrubbing towel 40 is to be dried, on the other hand, it is separated in the reverse order to the assembling process and it is exchanged into new one, if necessary.

INDUSTRIAL APPLICABILITY

As set forth in the foregoing, according to the preferred embodiments of the present invention, an air-injection type tool for scrubbing off the dirt on a body which is provided with an air-retaining body encompassed with a scrubbing towel and expanded like a ball when air is supplied such that the dirt on a user's body is scrubbed off gently, without having any damage or pain on the user's skin, as the air in the air-retaining body is moved.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. An air-injection type tool for scrubbing off the dirt on a body comprising:

an air-retaining body (2) formed of an elastic material expandable in an air injection manner, the air-retaining body (2) having a scrubbing towel (40) encompassed on the external surface thereof;

a disc-like support body (4) disposed at the inside of the air-retaining body (2) and having a cylindrical coupling protrusion (6) formed at the top central portion thereof, the coupling protrusion (6) having a piston (A) reciprocated therein such that the air generated by the reciprocating motion of the piston (A) is sent to the air-retaining body (2); and a cover body (12) adapted to be pressurized by a handle (18) screw-coupled with the coupling protrusion (6) of the support body (4) to come into close contact with the support body (4) such that the air-retaining body (2) is kept airtight.

2. The air-injection type tool according to claim 1, wherein the coupling protrusion (6) placed at the central portion of the support body (4) is of a cylindrical shape that is hollow in the interior thereof to conduct the reciprocating motion of the piston (A) therein, the coupling protrusion (6) having a stepped depression portion (8) at the lower end of the central portion thereof, the depression portion (8) having a cap (10) fit there into by means of screws, the cap (10) having a spring (20), a ball (22) and a packing (24) mounted at the inside thereof in such a fashion that the ball (22) comes into close contact with the packing (24) by the elasticity of the spring (20), such that the air-retaining body (2) is kept airtight.

3. The air-injection type tool according to claim 2, wherein the cap (10) has a plurality of air passages (34) pierced at the bottom surface thereof, for flowing in and out air therethrough, and the packing (24) is pierced up and down at the central portion thereof such that the ball (22) elastically supported by the spring (20) advances to the inside thereof, the packing (24) having a plurality of protrusions (26) formed at the top surface thereof, the protrusions (26) maintaining a given distance from the end portion of the piston (A) and distorted in shape by the piston (A) when the piston (A) is depressed.

4. The air-injection type tool according to claim 3, wherein the coupling protrusion (6) has a plurality of air discharging slots (28) radially formed along the inner periphery thereof thus to be contacted with the depression portion (8) that is formed at the lower end portion thereof, such that when the piston (A) is depressed, the protrusions (26) on the packing (24) are depressed thus to push the ball (22) by means of a protrusion (30) formed at the bottom end of the piston (A) and thus the air discharging slots (28) are opened to the outside thus to discharge the air in the air-retaining body (2).

5. The air-injection type tool according to claim 4, wherein in the case where a piston packing (32) mounted around the outer periphery of the front end of the piston (A) is placed at an operating position thereof, the air discharging slots (28) are formed lower than the piston packing (32) such that the air discharging slots (28) are closed normally and only if the piston (A) is depressed, the air discharging slots (28) are opened to the outside.

* * * * *